US008096443B2

(12) United States Patent
Mattox et al.

(10) Patent No.: US 8,096,443 B2
(45) Date of Patent: Jan. 17, 2012

(54) VARIABLE HEIGHT ADJUSTABLE STORAGE CAPACITY CONTAINER

(75) Inventors: David Sean Mattox, Lawrenceville, GA (US); Bartow Thomas, Jr., Marietta, GA (US)

(73) Assignee: VaraCase, LLC, Marietta, GA (US)

( * ) Notice: Subject to any disclaimer, the term of this patent is extended or adjusted under 35 U.S.C. 154(b) by 195 days.

(21) Appl. No.: 12/401,596

(22) Filed: Mar. 10, 2009

(65) Prior Publication Data

US 2010/0230428 A1 Sep. 16, 2010

(51) Int. Cl.
*B65D 43/12* (2006.01)
*B65D 85/00* (2006.01)

(52) U.S. Cl. ..... 220/788; 220/796; 220/8

(58) Field of Classification Search ..... 220/796, 220/788, 4.24, 4.25, 4.21, 8; 206/507
See application file for complete search history.

(56) References Cited

U.S. PATENT DOCUMENTS 2,454,455 A * 11/1948 Irwin ..... 220/8
5,265,749 A * 11/1993 Zutler ..... 220/4.24
5,388,714 A * 2/1995 Zutler ..... 220/4.24
6,886,703 B1 * 5/2005 Bonner ..... 220/8

* cited by examiner

*Primary Examiner* — J. Gregory Pickett
*Assistant Examiner* — Andrew Perreault
(74) *Attorney, Agent, or Firm* — George R. Reardon

(57) ABSTRACT

An adjustable storage container is formed with a removable lid that fits telescopically over the bottom section. The container's storage capacity is adjustable based upon the ability to increase and/or decrease the container's capacity by changing the orientation of the lid placement telescopically over the container bottom. Key slot ledges of differing depths that are designed into the side walls of the container's bottom section enable the lid to perch at different heights above the floor of the container depending upon which orientation of the lid is used when placing the lid telescopically over the container bottom. The abstract is not intended to be limiting in regard to the scope of the invention as defined by the claims to follow.

1 Claim, 3 Drawing Sheets

VARIABLE HEIGHT ADJUSTABLE STORAGE CAPACITY CONTAINER

BACKGROUND OF THE INVENTION

1. Field of the Invention

The present invention relates to adjustable volume containers. More specifically, the present invention relates to an adjustable storage capacity container whose internal volume can be adjusted to match the size of the items contained therein.

2. Description of the Prior Art

Adjustable volume containers are known in the prior art. More specifically, adjustable volume containers are known in the prior art that are adjustable via collapsible wall technology, adjustable via folding wall technology, adjustable via a threaded screw depth variation technology, and adjustable via telescoping cylindrical tubes that are adjusted via slotting teeth of one tube into variable length notches of the other tube. The inventive device is a departure from the pre-existing adjustable container patent technologies in that adjustable storage capacity is achieved via manipulation of the orientation of the lid placement onto the container bottom to create multiple storage capacity volumes, irrespective of the geometry of the storage container as designed. Key slot ledges of differing depths that are built into the side walls of the container's bottom section enable the lid to perch at different heights above the floor of the container depending upon which orientation of the lid is used when placing the lid telescopically over the container bottom.

SUMMARY OF THE INVENTION

The general purpose of the present invention is to provide a new adjustable storage capacity container mechanism of adjustability. A further object of the present invention is to provide a new adjustable storage container that is easy to use, of durable construction, and economical to manufacture and market. An additional specific object of the present invention is to provide adjustable storage capacity containment to house biological specimens. Still another specific object of the invention is to provide a variable height biological specimen storage container that enables the user to maximize available biological specimen storage space by adjusting the capacity of the specimen container according to the space requirement of the biological specimen being housed.

To attain this, the present invention generally comprises a container bottom with key slot ledges of differing depths arranged around the side walls of the container bottom. The telescoping container lid has key ledges built into its side walls to enable it to fit into the key slot ledges of the container bottom. The container lid key ledges are fitted into specific key slot ledges of the container bottom dependent upon which of the various lid orientations is chosen relative to the container bottom. The chosen key slot ledges enable the telescoping lid to perch at a specific height above the floor of the container bottom, which results in a chosen storage capacity of the container being attained.

Thus, the more general features of the invention have been broadly outlined in order that the detailed descriptions and claims that follow may be better understood. It is to be understood that the invention is not limited in its application to the details of design, geometry, and construction as set forth in the description contained herein or as illustrated in the drawings contained herein. The invention is capable of embodiments other than the preferred embodiment described herein and the invention is capable of being practiced and designed in various ways. The terminology utilized herein should not be regarded as limiting.

Those skilled in the art will appreciate that the concept upon which this disclosure is based may be readily adapted to other structural designs and purposes than that which is described herein. The following claims are intended to additionally include any such identifiably equivalent designs to the degree that they do not depart from the spirit and scope of the present invention.

DESCRIPTION OF THE PREFERRED EMBODIMENT

Figure 1:
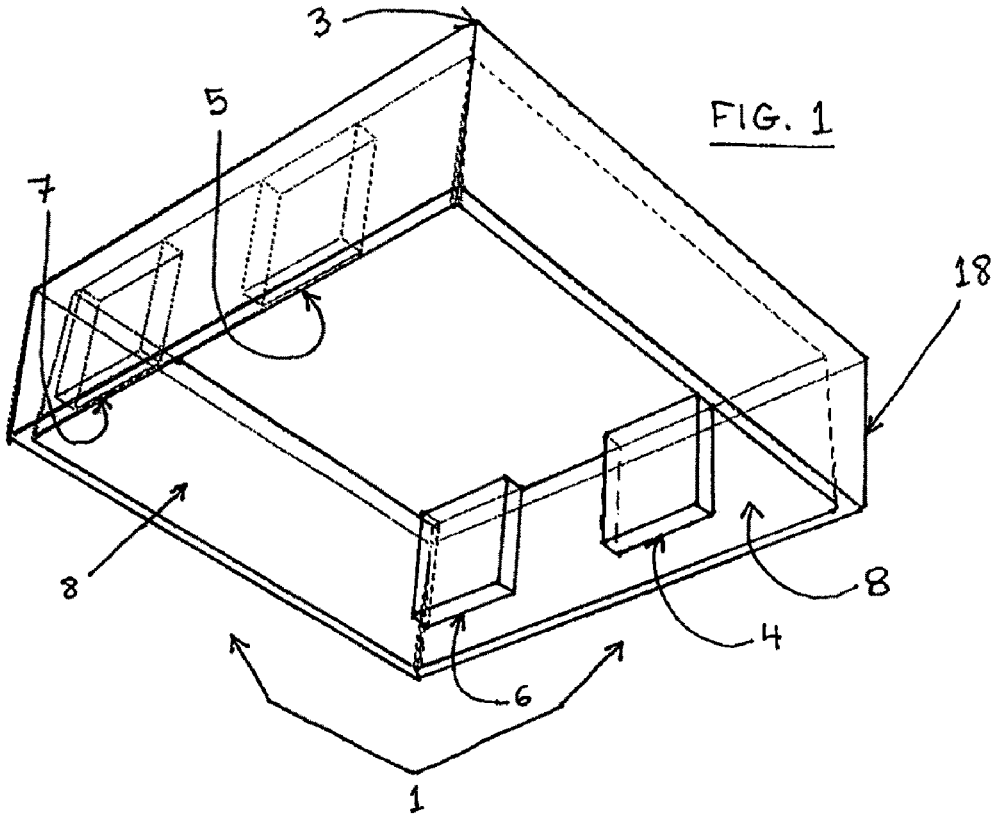
FIG. 1 is an underneath view schematic of the adjustable container lid looking inside the lid from the open end as it descends down towards its telescoping position over top of the container bottom represented in FIG. 2.
Figure 2:
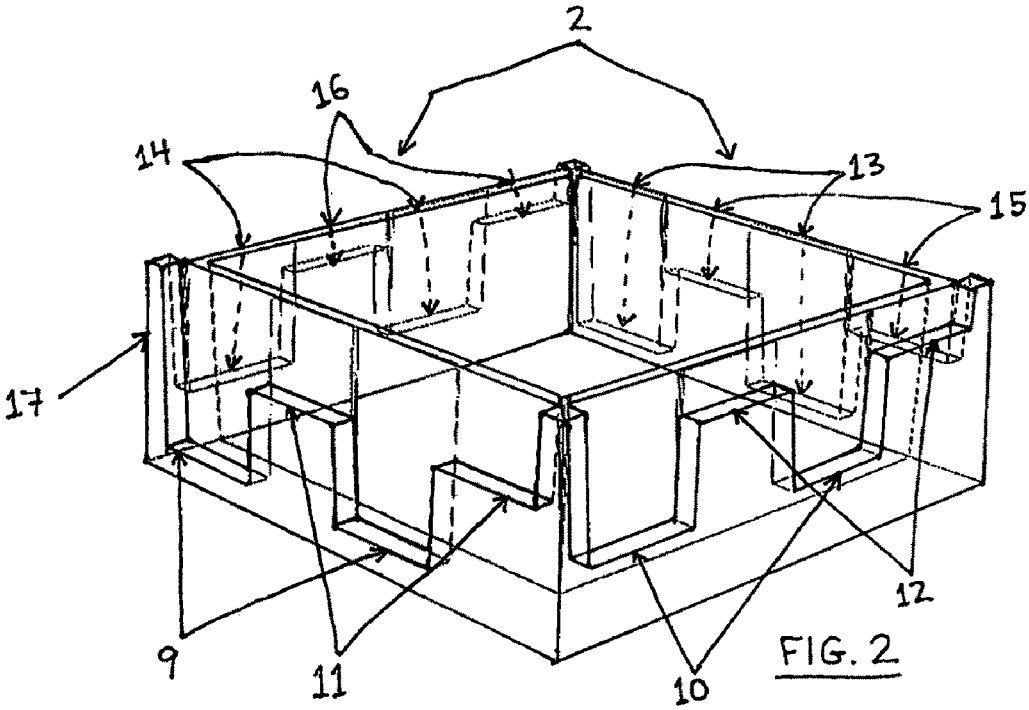
FIG. 2 is a schematic of the container bottom with its receptive key slot ledges of differing depths arranged around its outer walls.
Figure 3:
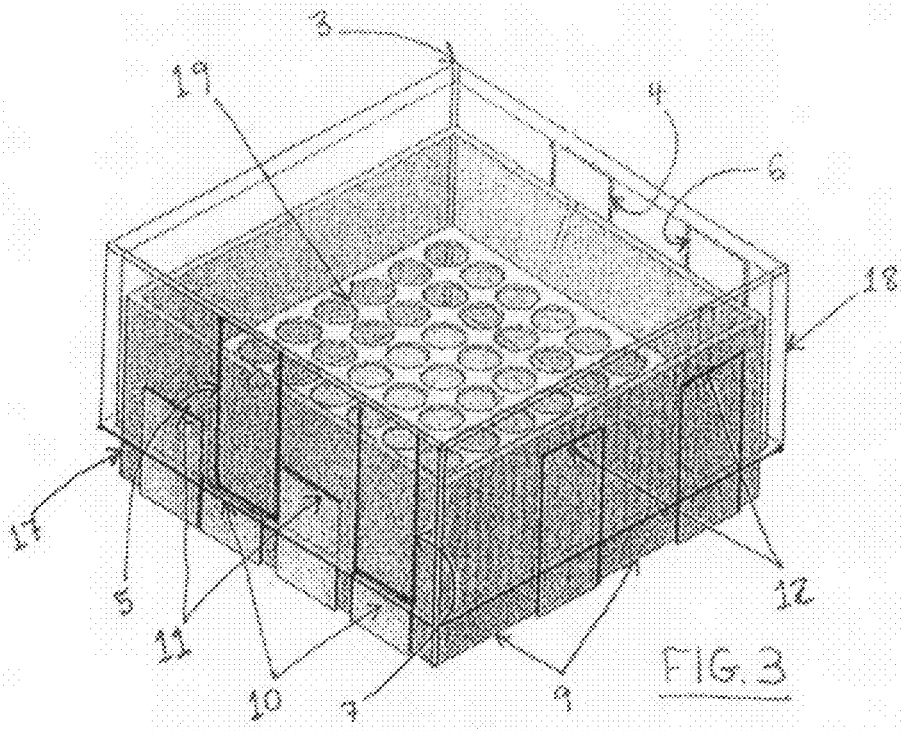
FIG. 3 is a schematic of the adjustable container in its telescoping state of assembly whereby the container lid key ledges are nested into the second deepest key slot ledges of four possible key slot ledge depths creating the second lowest storage capacity of four possible capacities achievable utilizing a square geometric design.
Figure 4:
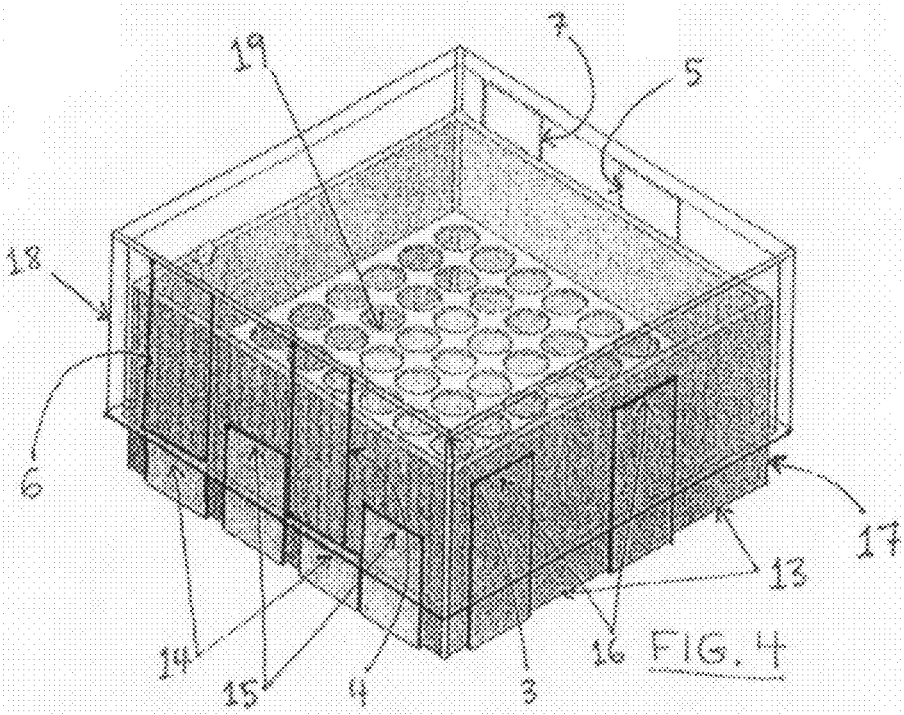
FIG. 4 is a reverse angle view of FIG. 3.
Figure 5:
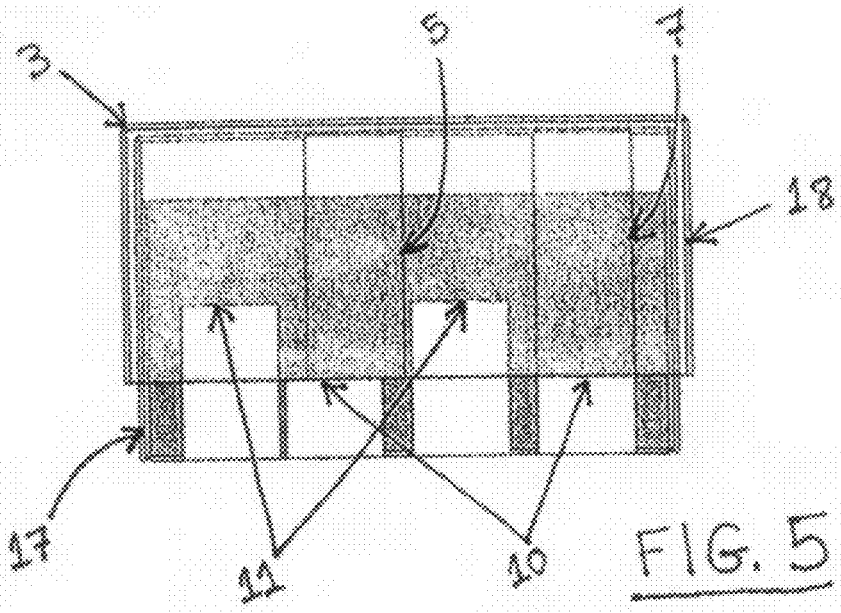
FIG. 5 is a side angle view of FIG. 3.
Figure 6:
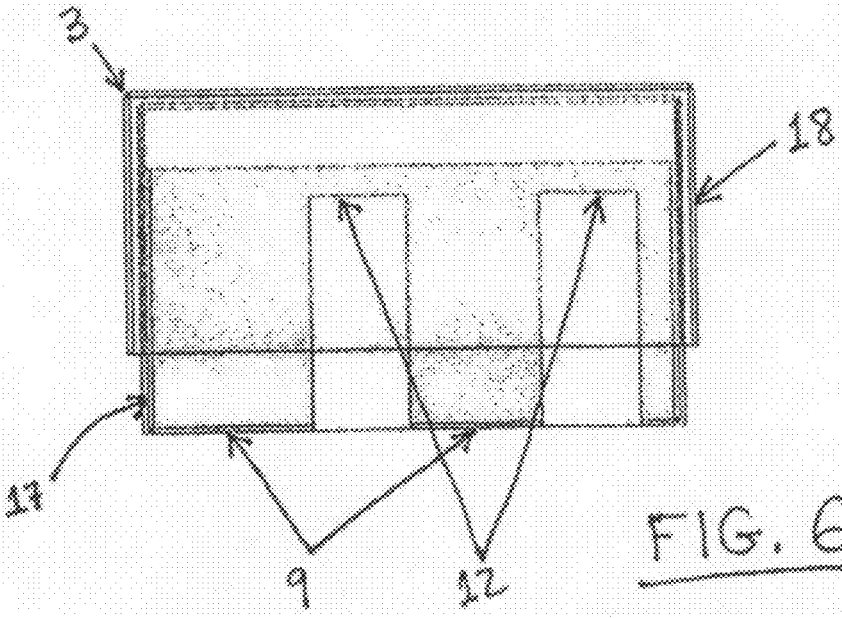
FIG. 6 is a reverse side angle view of FIG. 5.

As illustrated in FIGS. 1 through 6, the adjustable container invention is comprised of a container bottom, 2, and a removable container lid, 1. The top front corner of the closed top of the container lid, 3, is represented at the top of FIG. 1. The container lid embedded key ledges are designed into the internal walls, 8, of the lid (four internal walls are available in the square geometric design as referred to as faces one through four). Key ledges are designed into quadrants of inner wall faces one and three of the container lid as demonstrated by key ledge, 4, in quadrant three of face one and its corresponding key ledge, 5, in quadrant three of face three. To achieve balance and stability in the telescoping container lid when placed onto the container bottom, key ledges are also designed into quadrant one of face one, 6, and its corresponding key ledge, 7, in quadrant one of face three.

The adjustable container bottom, 2, has outer wall key slot ledges designed into quadrants of each container bottom outer wall. Within the square geometric embodiment, there are four possible box heights achievable that translate into four distinct storage capacities. The smallest storage capacity is achieved via placement of the removable container lid, 1, into the first lid to bottom orientation whereby key ledges, 7 and 5, nest into key slot ledges, 9, while key ledges, 6 and 4, nest into key slot ledges, 13. The second—incrementally greater—storage capacity is achieved via placement of the lid, 1, into the second lid to bottom orientation whereby key ledges, 7 and 5, nest into key slot ledges, 10, while key ledges, 6 and 4, nest into key slot ledges, 14. The third—incrementally greater still—storage capacity is achieved via placement of the lid, 1, into the third lid to bottom orientation whereby key ledges, 7 and 5, nest into key slot ledges, 15, while key ledges, 6 and 4, nest into key slot ledges 11. The fourth—and greatest volume—storage capacity is achieved via placement of the lid, 1, into the fourth lid to bottom orientation whereby key ledges, 7 and 5, nest into key slot ledges, 16, while key ledges, 6 and 4, nest into key slot ledges, 12.

The corners of the container bottom outer walls are represented by 17 while the corners of the container lid outer walls are represented by 18. A potential application of the adjustable storage capacity container is represented via an internal container bottom storage grid, 19, for biological specimen racking.

The invention claimed is:

1. An adjustable storage container comprising:

a container bottom section, the bottom section comprising a square bottom with a first container bottom vertical side having a first container top inner wall and a first container top outer wall, a second container top vertical side having a second container top inner wall and a second container top outer wall, a third container top vertical wall having a third container top inner wall and a third container top outer wall, a fourth container top vertical wall having a fourth container top inner wall and a fourth container top outer wall, the first container top outer wall having a first key slot ledge disposed in quadrant one with a first depth, a second key slot ledge disposed in quadrant two with a second depth, a third key slot ledge disposed in quadrant three with a first depth, a fourth key slot ledge disposed in quadrant four with a second depth, the second container top outer wall having a fifth key slot ledge disposed in quadrant one with a third depth, a sixth key slot ledge disposed in quadrant two with a fourth depth, a seventh key slot ledge disposed in quadrant three with a third depth, an eighth key slot ledge disposed in quadrant four with a fourth depth, the third container top outer wall having a ninth key slot ledge disposed in quadrant one with a first depth, a tenth key slot ledge disposed in quadrant two with a second depth, an eleventh key slot ledge disposed in quadrant three with a first depth a twelfth key slot ledge disposed in quadrant four with a second depth, the fourth container top outer wall having a thirteenth key slot ledge disposed in quadrant one with a third depth, a fourteenth key slot ledge disposed in quadrant two with a fourth depth a fifteenth key slot ledge disposed in quadrant three with a third depth, a sixteenth key slot ledge disposed in quadrant four with a fourth depth;

a lid top section, the lid top section comprising a square top dimensioned to fit snugly over the container bottom section, the square top having four vertical sides with a first lid top vertical side having a first lid top inner wall and a first lid top outer wall, a second lid top vertical side having a second lid top inner wall and a second lid top outer wall, a third lid top vertical wall having a third lid top inner wall and a third lid top outer wall, a fourth lid top vertical wall having a fourth lid top inner wall and a fourth lid top outer wall, the first lid top outer wall having a first key ledge disposed in quadrant one with a first height, a second key ledge disposed in quadrant three with a first height, the third lid top outer wall having a third key ledge disposed in quadrant one with a first height, a fourth key ledge disposed in quadrant three with a first height, wherein a first storage capacity is created by placing the lid top section on the container bottom section with the first key ledge nesting into the first key slot ledge, the second key ledge nesting into the third key slot ledge, the third key ledge nesting into the ninth key slot ledge the fourth key ledge nesting into the eleventh key slot ledge, wherein a second storage capacity is created by placing the lid top section on the container bottom section with the first key ledge nesting into the fifth key slot ledge, the second key ledge nesting into the seventh key ledge, the third key ledge nesting into the thirteenth key slot ledge, the fourth key ledge nesting into the fifteenth key slot ledge, wherein a third storage capacity is created by placing the lid top section on the container bottom section with the first key ledge nesting into the twelfth key slot a ledge, the second key ledge nesting into the tenth key slot ledge, the third key ledge nesting into the fourth key slot ledge, the fourth key ledge nesting into the second key slot ledge, wherein a fourth storage capacity is created by placing the lid top section on the container bottom section with the first key ledge nesting into the sixteenth key slot ledge, the second key ledge nesting into the fourteenth key slot ledge, the third key ledge nesting into the eight key slot ledge, the fourth key ledge nesting into the sixth key slot ledge; and a storage grid dimensioned to fit snugly in the container bottom section, the storage grid configured for racking of biological specimen containers.

* * * * *